United States Patent [19]

Tada

[11] 3,988,816

[45] Nov. 2, 1976

[54] MAGNET ROLLER FOR ELECTROSTATIC RECORD DEVELOPING DEVICE

[75] Inventor: Takeo Tada, Tokyo, Japan

[73] Assignee: TDK Electronics Company, Limited, Tokyo, Japan

[22] Filed: Oct. 23, 1975

[21] Appl. No.: 625,079

[30] Foreign Application Priority Data

Oct. 23, 1974 Japan ..... 49-128298[U]

[52] U.S. Cl. ..... 29/116 R; 118/637

[51] Int. Cl.[2] ..... B21B 31/02

[58] Field of Search ..... 29/110, 116 R, 132; 118/637

[56] References Cited

UNITED STATES PATENTS

| | | | |
|---|---|---|---|
| 3,626,898 | 12/1971 | Gawron | 118/637 |
| 3,739,749 | 6/1973 | Kangas et al. | 118/637 |
| 3,783,828 | 1/1974 | Forgo et al. | 118/637 |
| 3,865,080 | 2/1975 | Hudson | 118/637 |
| 3,882,821 | 5/1975 | Katayama et al. | 118/637 |
| 3,906,121 | 9/1975 | Fraser et al. | 118/637 |

*Primary Examiner*—Wayne L. Shedd

*Attorney, Agent, or Firm*—Cooper, Dunham, Clark, Griffin & Moran

[57] ABSTRACT

An improved roller, consisting in part of a cylindrical permanent magnet, for use in electrostatic record developing devices is disclosed. Of the plurality of magnetic poles formed on the cylindrical surface of the permanent magnet, two of the same polarity are positioned with an auxiliary magnetic pole of opposite polarity located therebetween. The magnetic field intensity of the auxiliary magnetic pole is from about 1/10 to 1/2 that of the other magnetic poles.

8 Claims, 6 Drawing Figures

(A)

(B)

MAGNET ROLLER FOR ELECTROSTATIC RECORD DEVELOPING DEVICE

FIELD OF THE INVENTION

This invention relates to electrophotography, and concerns in particular the roller adapted for use in developing, by the magnetic brush method, the latent images formed electrophotographically on the electrostatic recording medium in a reproducing device.

BACKGROUND OF THE INVENTION

One of the methods known of developing into visible printed impression the latent electrostatic images created on the surface of the recording medium is the magnetic brush method. In this method, which is based on the use of a magnet roller, it is well known that developing performance depends much upon the way the magnet roller transfers the powdery developer.

Yamashita et al. U.S. Pat. No. 3,828,730 discloses a cylindrical permanent magnet structure for use in developing an electrostatic image, in which an odd number of axially extending magnetic poles is utilized. The developing apparatus of that patent is, however, subject to clogging by the developer powder, thereby imposing undesirable load and reducing performance.

An object of the present invention is to provide a magnet roller which readily and with high efficiency releases the adhering particles of powdery developer from the surface of its rotating sleeve after the particles have moved through the region of magnetic brush formation where the developing action takes place. Another object of this invention is to provide a magnet roller which picks up a proper amount of powdery developer from the pool in the containing vessel to transport it to the magnetic brush region so that a magnetic brush suited to developing action will be maintained at all times in operation. Another object is to provide magnetic rollers which mix the toner and carrier components of the picked-up or adhering powdery developer so that a more thoroughly and uniformly mixed powder will be brought into the developing region, which produce developed images high in quality, or which cost much less to manufacture and are adapted to high-performance developing.

SUMMARY OF THE INVENTION

In the present invention, an auxiliary magnetic pole is interposed between two magnetic poles of like polarity in a magnetic roller assembly of the type disclosed in the Yamashita et al. patent referred to above. The auxiliary magnetic pole is of opposite polarity to that of the poles between which it is positioned, and is of a lesser magnetic field intensity than that of the bracketing poles, particularly the pole preceeding the auxiliary pole in the direction of rotation of the roller assembly and preferably about 1/10 to 1/2 the magnetic field intensity of the preceding pole or bracketing poles.

DETAILED DESCRIPTION

Figure 1:
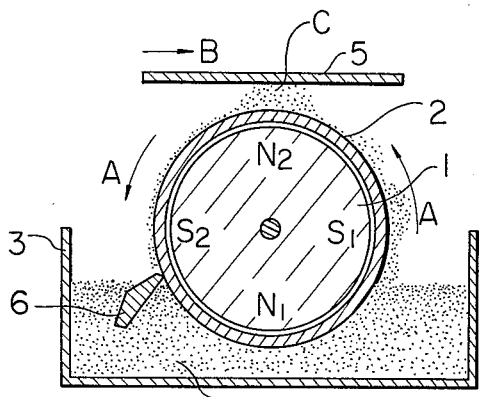
Fig. 1 (PRIOR ART)
FIG. 1 is a sectional view, transverse to the axis, of a conventional prior art magnet roller.

Referring first to FIG. 1, a typical magnet roller conventionally used in the prior art is shown. A cylindrical permanent magnet 1 has an even number of magnetic poles, N and S, formed on its surface, the N and S poles being spaced apart nearly equidistantly and in an alternating order. The magnet 1 is positioned inside a rotating cylindrical sleeve 2 made of a non-magnetic material and arranged to revolve around the magnet 1 in the direction of arrow A, with a constant running clearance maintained all around between the two. The vessel 3 contains powdery developer 4, a mixture of toner powder and carrier powder.

Rotating sleeve 2 is so located in vessel 3 that its lower part remains immersed in the pool of powdery developer 4. Above and over rotating sleeve 2 an electrostatic recording sheet 5, on which electrostatically latent images have been formed, moves in the direction of arrow B with a properly predetermined clearance secured between sleeve 2 and sheet 5.

In a developing operation, powdery developer 4 experiences magnetic attraction from that immersed part of sleeve 2 adjacent to magnetic pole $N_1$ of magnet 1 and, because of its iron particles, adheres to the surface of that part of sleeve 2. The fine particles of developer 4, adhering to the surface of sleeve 2 now running, come next to the position adjacent to the subsequent magnetic pole $S_1$ to experience similar attraction. As rotating sleeve 2 runs, the fine particles under consideration shift sequentially past poles $N_2$ and $S_2$. Since the adhering fine particles move through a magnetic field that alternates in polarity, the toner and carrier particles constituting this attracted portion of developer 4 become mixed more thoroughly. At each magnetic pole, moreover, the attracted fine particles align themselves into a cluster of straight threads standing nearly perpendicular to the surface of sleeve 2, presenting a brushlike appearance C, for which the term "magnetic brush" has been coined.

As magnetic brush C rubs the surface of sheet 5 on which latent images are carried in the form of electrostatic charges of varied intensity, the charged portions of this surface selectively attract toner particles from brush C, thus rendering the images visible with toner particles to accomplish a process corresponding to the photographic developing process. The other toner particles, together with iron particles, that are not drawn to the surface of recording sheet 5 remain in brush C and move to the position adjacent to magnetic pole $S_2$ and then toward the pool of powdery developer 4. Just before reaching the pool, the remnant brush C meets stationary doctor blade 6, which scrapes the brush from the surface of sleeve 2 into the pool of powdery developer 4.

In the magnet roller shown in FIG. 1 as typical of conventional magnet rollers, the magnetic poles formed of magnet 1 are relatively wide apart and few in number, so that the magnetic attraction which powdery developer 4 experiences is not strong. Consequently, the amount of developer picked by the surface of rotating sleeve 2 from the pool of developer 4 is not adequate enough to assure uniform and consistent developing action to the latent images on sheet 5; a result is that the developed images are heavily inked in some portions and lightly in other portions. This inconsistency or lack of evenness is a major drawback of conventional magnet rollers.

To overcome this drawback, Yamashita et al. have proposed a new magnet roller, disclosed in U.S. Pat. No. 3,828,730 and which is here reproduced in FIG. 2. According to Yamashita's magnet roller, an odd number of magnetic poles are formed of permanent magnet 1, the main magnetic pole $N_3$ being in apposition to electrostatic recording sheet 5. The main pole $N_3$ is immediately followed by two poles of the same polarity, shown as $S_3$ and $S_4$ in FIG. 2. In operation, the particles of developer picked by and adhering to the surface of rotating sleeve 2, due to magnetic attraction exerted by magnet 1 and also to the revolving motion in the direction A of sleeve 2, give rise to frictional force at the sleeve surface and, immediately after moving past one magnetic pole, experience another strong attraction from the next pole to align themselves into straight threads bunched together and to produce a magnetic brush C as described above. At each position of a magnetic pole above the pool of developer 4, magnetic brush C is formed by the adhering particles. Magnetic brush C above main pole $N_3$ rubs the surface of electrostatic recording sheet 5, on which the latent images are carried as explained before, to develop and visualize the image much in the same way as described before. After this rubbing action, the remaining particles of brush C move with the sleeve surface through two successive positions where poles $S_3$ and $S_4$ are located and, at these positions, experience repulsion because the two poles are of the same polarity. The remaining particles are thus repelled off the surface of sleeve 2 and fall into the pool of developer in the vessel 3.

Figure 2:
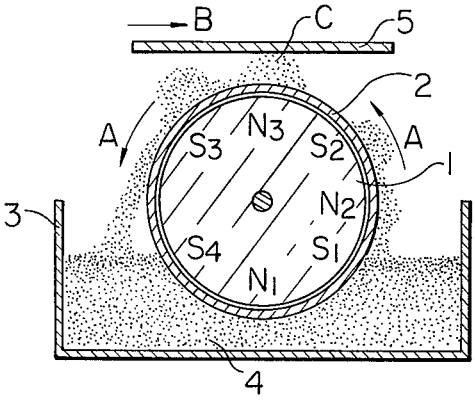
Fig. 2 (PRIOR ART)
FIG. 2 is a similar sectional view of a conventional magnet roller as disclosed in Yamashita et al. U.S. Pat. No. 3,828,730.

In contrast to the magnet roller of FIG. 1, that of FIG. 2 is obviously more efficient in releasing the adhering particles of powdery developer 4 from the surface of sleeve 2 after the particles have moved past the position where the developing action occurs. The striking difference is that this release is magnetically accomplished whereas, in the roller of FIG. 1, a doctor blade is used to scrape the particles off the sleeve surface. Another improvement over that of FIG. 1 is that, since a doctor blade is not used, the sleeve surface is not subject to any abrasive injury that would be inevitable where a doctor blade has to be used.

Because the magnet roller of FIG. 2 has two magnetic poles of the same polarity, adjacent to each other and located immediately beyond main pole $N_3$ in the direction of arrow A, the adhering particles of developer 4 experience two forces simultaneously upon moving past pole $S_3$, one of the two poles of the same polarity and immediately next to main pole $N_3$: one force is the repulsive force exerted by pole $S_4$, which tends to repel the particles from the surface of sleeve 2, and the other is the decreasing but persisting attractive force due to main pole $N_3$. Some of the particles under consideration, therefore, fly back toward magnetic brush C and accumulate in the clearance near brush C between recording sheet 5 in motion and rotating sleeve 2. A critical drawback of Yamashita's magnet roller lies in that this accumulation increases in time to clog the clearance and thus hinder the revolving motion of sleeve 2, thereby imposing undesirable load on sleeve 2 and resulting in reduced developing performance.

Figure 3:
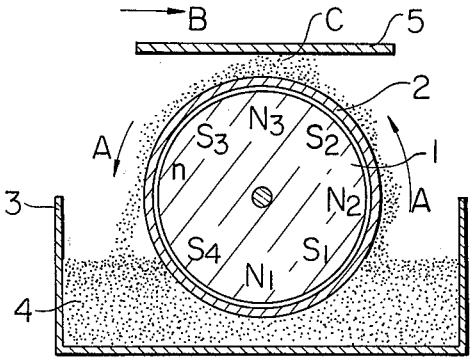
FIG. 3 is a similar sectional view of a magnet roller according to the present invention.

FIG. 3 shows a magnet roller according to this invention, constituting a presently preferred embodiment, in its simplest form complete with a minimum amount of powdery developer necessary for the purpose of description and also with a vessel sized to contain that much developer. As an example only, permanent magnet 1 may be 30 mm in diameter and 292 mm in axial length, and made of barium ferrite; rotating sleeve 2, made of aluminum, is arranged to revolve around the magnet 1. In this preferred mode of implementing the present invention, the material of permanent magnet 1 need not be barium ferrite; it may be, instead, any of a group of magnetic materials comprising Sr ferrite, barium-Sr ferrite, rare-earth-cobalt magnet, Mn-Bi magnet, Mn-Al magnet, Fe-Co magnet, and Alnico magnet, or a rubber or plastic magnet containing any combination of these magnetic materials to name some examples. Likewise, the material of rotating sleeve 2, need not be aluminum, as stated above, but may be brass, stainless steel, phenol resin or s similar nonmagnetic material, to name some examples.

Rotating sleeve 2 is coaxial with stationary permanent magnet 1 thereinside, and revolves around magnet 1. Vessel 3, made of aluminum, e.g., or a similar nonmagnetic material, contains powdery developer 4, a mixture of toner powder and carrier powder. As shown, magnet 1 has, on its cylindrical surface, a total of eight magnetic poles created by forced magnetization along its axial length, of which one is an auxiliary pole n (north), four are S (south) poles designated $S_1$, $S_2$, $S_3$ and $S_4$, and the remaining three are N (north) poles designated $N_1$, $N_2$ and $N_3$. Auxiliary pole n is of such strength as to provide a magnetic field whose intensity, at its surface, is preferably about two-tenths (2/10) of one field produced by each of the other S and N poles at the surface of magnet 1 and particularly that one of the bracketing poles $S_3$ and $S_4$ that precedes the auxiliary pole in the direction of rotation of sleeve 2. The field intensity of the S and N poles is preferably 1,000 gausses or thereabout.

These poles are nearly equidistantly located in an alternating order, with an S pole coming after an N pole, and each may measure 6 mm in width and 292 mm in length, e.g. Pole $N_3$ is at the top, and is the one closest to electrostatic recording sheet 5, while pole $N_1$ is at the bottom, backing that portion of sleeve 2 immersed in the pool of powdery developer 4 in vessel 3. Needless to say, these polarity designations are arbitrary and may be reversed to replace an S pole by an N pole and, in such a case of polarity reversal, the polarity of the auxiliary pole must be changed from n to s (south). The dimensions of auxiliary pole n or s need not be of the same values as those of the other poles. It should be pointed out that, in the preferred mode of this invention shown, permanent magnet 1 and its magnetic poles are both 292 mm, e.g.; thus preferably the magnetic poles extend along the full length of the permanent magnet.

In the operation of a magnet roller constructed as described above, the particles of powdery developer 4 adhering to the surface of sleeve 2 because of magnetic attraction experience frictional force at every point of the surface of sleeve 2 as the sleeve revolves in the direction A. After being picked up by sleeve 2 from the pool of developer 4, the particles become densely bundled at each magnetic pole to assume the shape of straight threads under the influence of an intense magnetic field and, at above main pole $N_3$, act as a magnetic brush C. Electrostatic recording sheet 5 moving in the direction B is continuously rubbed by magnetic brush C, so that more or less toner particles are picked from brush C by the passing latent images formed on sheet 5 in the manner already described. Thus, the latent images become visible images, made visible by the toner particles.

The function of auxiliary pole n will be explained by considering a certain axially extending portion, covered with powdery developer, of the surface of sleeve 2. This portion, in passing through the region of magnetic brush formation at main pole $N_3$, gives off some of its toner particles to recording sheet 5 as mentioned before; thereupon, the remaining toner and carrier particles move to pole $S_3$ and then to auxiliary pole n. At this juncture, because of the magnetic repulsion between poles $S_3$ and $S_4$, the particles are repelled from the surface of sleeve 2. The magnetic field of auxiliary pole n, which is of opposite polarity with respect to that of magnetic poles $S_3$ and $S_4$, is so directed that the developer particles being released from the surface of the sleeve portion under consideration are prevented by this magnetic field from being attracted toward main pole $N_3$; in other words, the tendency of the released particles to fly back to and clog the clearance near the region of magnetic brush formation is eliminated by auxiliary pole n.

Figure 4:
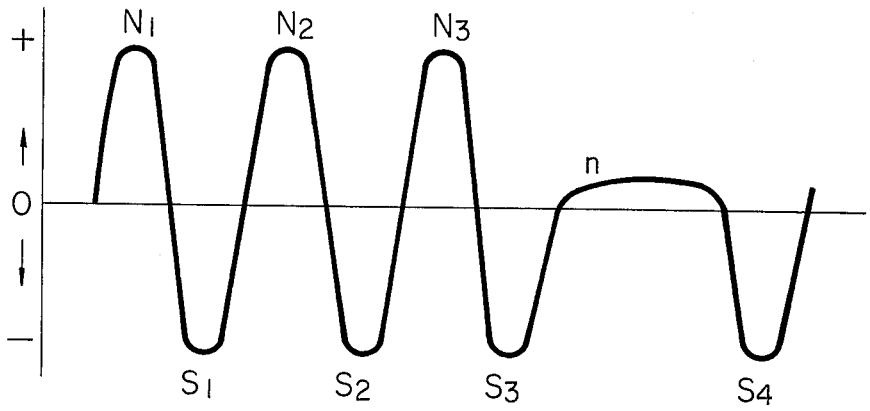
FIGS. 4(A) and (B) illustrate, in a developed view, the variation of the magnetic force exerted by each magnetic pole in a roller according to the present invention.
Figure 4:
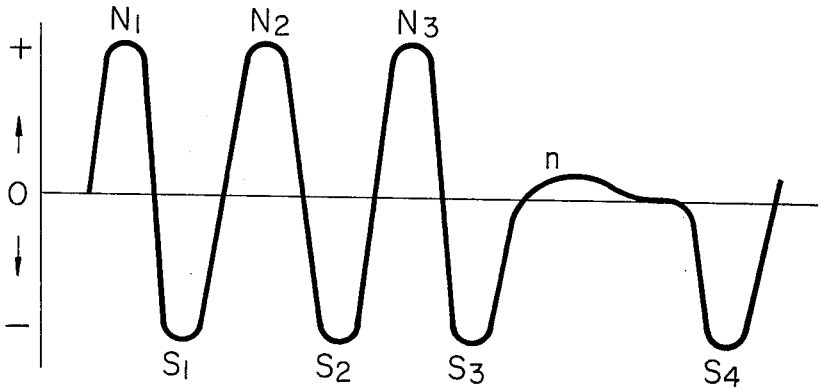

The relationship between the magnetic field of auxiliary pole n and the revolving speed of sleeve 2 will be considered from the standpoint of the purpose served by this pole. Refer to FIG. 4 showing, in a graphically developed view, the varied distribution of magnetic force in the circular direction due to the magnetic poles formed of the magnet 1 of FIG. 3. Graphs (A) and (B) represent two instances of pole n; this auxiliary pole is wide in the instance of graph (A) but is narrow in that of graph (B). Note that the interfering field of a wide pole n is more intense and extensive in the circular direction than that of a narrow pole n. The effective field intensity of pole n is affected by the revolving speed of sleeve 2 and by the frictional force existing between the adhering particles of developer and the surface of sleeve 2. Release of adhering particles from sleeve 2 in the region of poles $S_3$ and $S_4$ with auxiliary pole n located therebetween is more facilitated by a higher revolving speed of sleeve 2. Conversely, if the speed is low, then the clogging tendency, mentioned above, may assert itself to foul the clearance between sleeve 2 and electrostatic recording sheet 5.

The foregoing functional description of the magnet roller of FIG. 3 is based on the results obtained by the present inventor from experimental use of a magnet roller constructed and arranged as described above. From the results obtained, the graph of FIG. 5 has been prepared; it constitutes a characteristic curve and illustrates the degree with which the developer particles are repelled and released from the surface of sleeve 2 in the region of poles $S_3$ and n, where sleeve 2 is made to run at 180 revolutions per minute.

Figure 5:
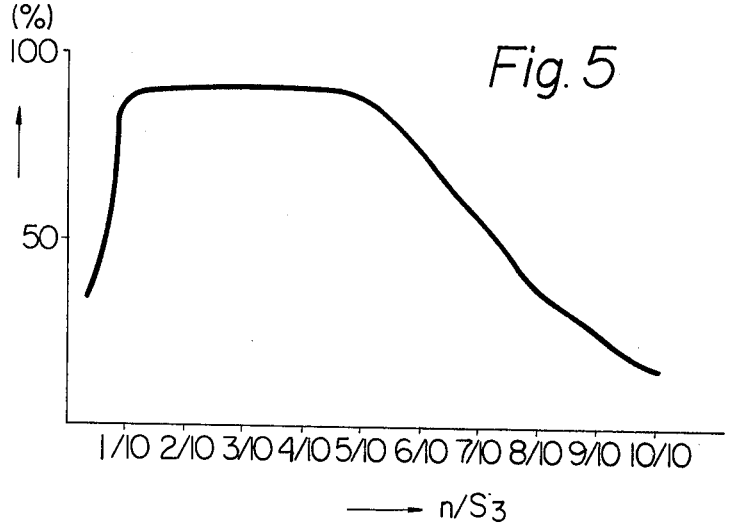
FIG. 5 shows, by a characteristic curve, the release of powdery developer from the rotating sleeve of a magnet roller in accordance with the present invention.

In the graph of FIG. 5, the abscissa is a scale of the ratio, in terms of magnetic field intensity of auxiliary pole n to the pole $S_3$, and the ordinate is a percentage scale in which the amount of the adhering particles of developer, released from the surface of sleeve 2 in the region ahead of auxiliary pole n and above the surface of the pool of powdery developer 4, is plotted as a percentage for each value of $n/S_3$ ratio.

It will be noted in the graph of FIG. 5 that, as the $n/S_3$ ratio decreases, the release of powdery developer from sleeve 2 begins to decrease rapidly at about 1/10 ratio. With such a small ratio of magnetic field strength of pole n to pole $S_3$, the developer particles that have emerged from the region of magnetic brush formation at pole $N_3$ and are approaching the position of pole $S_3$ experience greater pull from pole $N_3$ behind than from auxiliary pole n ahead, so that more and more particles shift back toward pole $N_3$ to accumulate in the clearance between sleeve 2 and recording sheet 5. As has been stated, such accumulation results in clogging to impose extra load on rotating sleeve 2 and cause the latent images of recording sheet 5 to be developed unevenly.

As the ratio increases, on the other hand, the release of powdery developer begins to deteriorate gradually at about 1/2 ratio. This is accounted for by the fact that the magnetic field due to auxiliary pole n is then so intense as to increasingly nullify the magnetic repulsion between pole $S_3$ and $S_4$. In short, the net repulsion necessary for repelling the adhering particles from the surface of sleeve 2 decreases as pole n becomes stronger relative to the other poles to provide a ratio larger than 1/2.

Thus it is believed that the $n/S_3$ ratio should lie between about 1/10 and 1/2.

In summary, a magnetic roller according to this invention has a plurality of magnetic poles created by forced magnetization on the surface of its stationary magnet; of these poles, two of the same polarity are located adjacent each other with an auxiliary pole of opposite polarity located therebetween. The two like-polarity poles are next to the one forming the magnetic brush in rubbing contact with the image carrying surface of the electrostatic recording sheet. The magnetic strength in terms of field intensity of the auxiliary pole is preferably between about 1/10 and 1/2 of those of the other poles, and particularly of the pole preceding the auxiliary pole in the direction of rotation of the sleeve forming part of the magnet assembly. Thus, as will be seen from the graph of FIG. 5, the release of developer particles from the rotating sleeve in the area downstream to the region of magnetic brush formation is effected with an efficiency of nearly 100%, so that, in operation, the magnet roller is freed from the extra load to which its rotating sleeve would be otherwise subjected, and enjoys the advantage of its magnetic brush being formed always with fresh developer particles picked anew by the rotating sleeve from the pool of powdery developer.

Modifications of the preferred embodiment will suggest themselves to those skilled in the art. The invention, therefore, should be taken to be defined by the following claims.

I claim:

1. In a roller for use in the developing section of an electrostatic reproducing device, including a cylindrically shaped permanent magnet means on whose cylindrical surface are formed a plurality of magnetic poles, the main pole thereof being located in apposition to the image carrying surface of an electrostatic recording medium, and also including a rotating non-magnetic cylindrical sleeve surrounding said permanent magnet means, in which two adjacent magnetic poles of the same polarity are located among the plurality of magnetic poles formed on said permanent magnet means, the improvement comprising an auxiliary magnetic pole of opposite polarity from that of said two adjacent magnetic poles and located between said two adjacent magnetic poles, the magnetic field intensity of said auxiliary magnetic pole being less than the magnetic intensity of that one of said two adjacent magnetic poles preceding said auxiliary pole in the direction of rotation of said sleeve.

2. A roller as claimed in claim 1, wherein the magnetic field intensity of said auxiliary magnetic pole is about 1/10 to 1/2 of the intensity of said preceding adjacent pole.

3. A roller as claimed in claim 1, wherein the polarity of said two adjacent magnetic poles in south polarity, and the polarity of said auxiliary magnetic pole is north polarity.

4. A roller as claimed in claim 1, wherein the polarity of said two adjacent magnetic poles is north polarity, and the polarity of said auxiliary magnetic pole is south polarity.

5. A roller as claimed in claim 1, wherein said permanent magnet means is made of barium ferrite.

6. A roller as claimed in claim 2, wherein said two adjacent magnetic poles are of substantially equal magnetic field intensity.

7. A roller as claimed in claim 2, wherein all of said magnetic poles, except for said auxiliary pole, are of substantially equal magnetic field intensity.

8. A roller as claimed in claim 2, wherein said two adjacent magnetic poles are of substantially different magnetic field intensity.

* * * * *